US007605833B2

(12) United States Patent
Shimazu

(10) Patent No.: US 7,605,833 B2
(45) Date of Patent: Oct. 20, 2009

(54) WRITING DEVICE

(75) Inventor: Akihiko Shimazu, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 11/961,748

(22) Filed: Dec. 20, 2007

(65) Prior Publication Data

US 2008/0199219 A1 Aug. 21, 2008

(30) Foreign Application Priority Data

Feb. 20, 2007 (JP) ..... 2007-039123

(51) Int. Cl.

| | |
|---|---|
| ***B41J 2/385*** | (2006.01) |
| ***B41J 2/45*** | (2006.01) |
| ***B41J 15/14*** | (2006.01) |
| ***B41J 2/435*** | (2006.01) |
| ***G03G 15/04*** | (2006.01) |

(52) U.S. Cl. ..... 347/138; 347/130; 347/238; 347/242; 347/263; 399/220

(58) Field of Classification Search ..... None
See application file for complete search history.

(56) References Cited

U.S. PATENT DOCUMENTS

| | | | | |
|---|---|---|---|---|
| 4,703,334 | A * | 10/1987 | Mochimaru et al. | 347/130 |
| 4,928,119 | A | 5/1990 | Walker et al. | |
| 5,036,339 | A | 7/1991 | Hediger | |
| 5,218,383 | A * | 6/1993 | Kondou et al. | 347/130 |
| 6,536,343 | B2 * | 3/2003 | Onuma | 101/401.1 |
| 6,995,782 | B2 * | 2/2006 | Oda et al. | 347/138 |
| 2003/0113729 | A1 * | 6/2003 | DaQuino et al. | 435/6 |
| 2007/0126852 | A1 * | 6/2007 | Fukutome et al. | 347/262 |

FOREIGN PATENT DOCUMENTS

| | | |
|---|---|---|
| JP | 58-205171 | 11/1983 |
| JP | 58205171 A | 11/1983 |
| JP | 62-242929 | 10/1987 |

* cited by examiner

*Primary Examiner*—Matthew Luu
*Assistant Examiner*—Kendrick X Liu
(74) *Attorney, Agent, or Firm*—Finnegan, Henderson, Farabow, Garrett & Dunner, L.L.P.

(57) ABSTRACT

A writing device to write an image onto a photoconductor, including a print head having plural LEDs, a first supporting member, having a position determining section to determine the position of the print head, and an adjustment screw, and a second supporting member, having a reference shaft which comes into contact with the first supporting member and movably supports the first supporting member while moving to or separating from the photoconductor, and a pressuring member which presses the first supporting member against the reference shaft, wherein the second supporting member is engaged with the first supporting member by the adjustment screw, whereby when the adjustment screw is rotated, the print head is shifted along with the first supporting member, and a first direction joining the position determining section and the adjustment screw makes a right angle with a second direction joining the adjustment screw and the reference shaft.

6 Claims, 5 Drawing Sheets

WRITING DEVICE

CROSS REFERENCE TO RELATED APPLICATION

This application is based on Japanese Patent Application No. 2007-039123 filed on Feb. 20, 2007 with the Japanese Patent Office, the entire content of which is hereby incorporated by reference.

FIELD OF THE INVENTION

The present invention relates to a writing device, and in particular, to a writing device in which the distance between an LED print head and a photoconductor can be easily adjusted.

BACKGROUND OF THE INVENTION

Generally, among the writing devices which are used for image forming apparatuses exhibiting an electro-photographic process, a writing device is well known in which LED print heads (hereinafter referred, to "LPH"), having an LED array structured of a plurality of LEDs, are used, and which exposes an image onto a photoconductor to form a latent image. In said LPH, a converging-rod-lens array, generally called a "SELFOC lens", is used to concentrate light rays so that high resolution is obtained. If the distance between the LPH and the photoconductor varies, the image exposed on the photoconductor becomes out-of-focus, and the resolution is reduced. Further, in typical color image forming apparatuses which superpose plural color images, color unevenness usually tends to occur.

In the above-described writing device, in order to obtain preferred type of images, positional accuracy within ±0.1 mm is generally essential for the position of the LPH with respect to the focal surface on the drum of the photoconductor. The more the PLH approaches the heat focus, the more the image quality improves. Therefore, the positional adjustment of the LPH requires precise control.

However, in the writing devices which has been conventionally used for the image forming apparatuses, such as copy machines and printers in business offices, the accuracy for assembling the LPH onto the photoconductor tends to be controlled only by the manufacturing accuracy of mechanical parts to support the LPH. In such cases, since the focal depth of the LPH is generally ±0.06 mm, the accuracy for manufacturing the member to support the LPH is not enough to realize the above targeted positional accuracy which is within ±0.1 mm.

Unexamined Japanese Patent Application Publication No. 58-205171 discloses an electrostatic printer having a print head unit, in which a light emitting section and a SELFOC lens are mated, and having a positional adjustment member which enables precise adjustment of the assembling position of said print head unit onto the electrostatic printer.

Further, Unexamined Japanese Patent Application Publication No. 62-242,929 discloses a writing device having a light emitting section on a frame, and the light emitting section is adjustable, being supported by a positional adjustment member.

In Unexamined Japanese Patent Application Publication No. 58-205171, when the print head unit is to be assembled onto a mounting member of the electrostatic printer, a positional adjustment screw of the mounting member is rotated so that the bottom face position of a mounting plate of the print head unit can be moved, whereby after the mounting position of the print head unit is adjusted, the print head unit is fastened by a fastening screw. Due to this structure, the distance between the print head unit and the photoconductor is controlled. However, since the positional adjustment screw and the mounting member are not firm contact with each other, they are not stable in relation to each other, that is, the movement of the print head unit becomes unstable, which results in inaccurate positioning of the print head unit. Further, when the above cited screw is fastened, the position of the print head unit in the longitudinal direction, (which is the axial direction of the photoconductor) may shift, which results in unstable repeatability of the adjustment, as well as an out-of-focus of the produced image.

In Unexamined Japanese Patent Application Publication No. 62-242929, a supporting member to support an led array head is allowed to come into contact with a cylindrical positional adjustment member, having an eccentric hole, mounted on a frame, and said positional adjustment member is then rotated. By this structure, the supporting member is moved so that the distance between the LED array head and the photoconductor is adjusted, and the supporting member is mechanically fastened onto the frame by a fastening screw and nut. However, since the supporting member and the positional adjustment member are not in firm contact with each other, they are not stable. The movement of the LED array head tends to become unstable, which results in inaccurate positioning. Further, when the fastening screw and nut are fastened, the supporting member tends to be declined so that the position of the LED array head is shifted in the longitudinal direction, which tends to result in an out-of focus of the produced image.

SUMMARY OF THE INVENTION

The present invention has been achieved to overcome the above problems, and an object of the present invention is to provide a writing device, in which the positional adjustment between the LPH and the photoconductor can be easily conducted, further, any back-lash due to undesired positional adjustment and out-of-focus images are prevented. Yet further, high positional repeatability of the focus adjustment for the LED print head is obtained.

The object can be attained by the structure described below.

A writing device to write an image onto a photoconductor, includes:

1) a print head having a plurality of LEDs arranged above and across the width of the photoconductor, which forms electrostatic latent images on the photoconductor, (2) a first supporting member, having a position determining section to determine the position of the print head, and an adjustment screw which is capable of being locked, in which the first supporting member allows the position determining section to come into contact with the print head and thereby supports the print head, and (3) a second supporting member, having a reference shaft which comes into contact with the first supporting member and movably supports the first supporting member while moving to or separating from the photoconductor, and a pressuring member which presses the first supporting member against the reference shaft, wherein the second supporting member is engaged with the first supporting member by the adjustment screw, whereby when the adjustment screw is rotated, the print head is shifted along with the first supporting member moving to or separating from the photoconductor so that the position of the print head is precisely adjusted, and wherein a first direction which is joining the position determining section and the adjustment screw makes a right angle with a second direction which is joining the adjustment screw and the reference shaft.

BRIEF DESCRIPTION OF THE DRAWINGS

FIG. 3(*b*) is an enlarged view of a portion of FIG. 3(*a*).

DETAILED DESCRIPTION OF THE INVENTION

Figure 1:
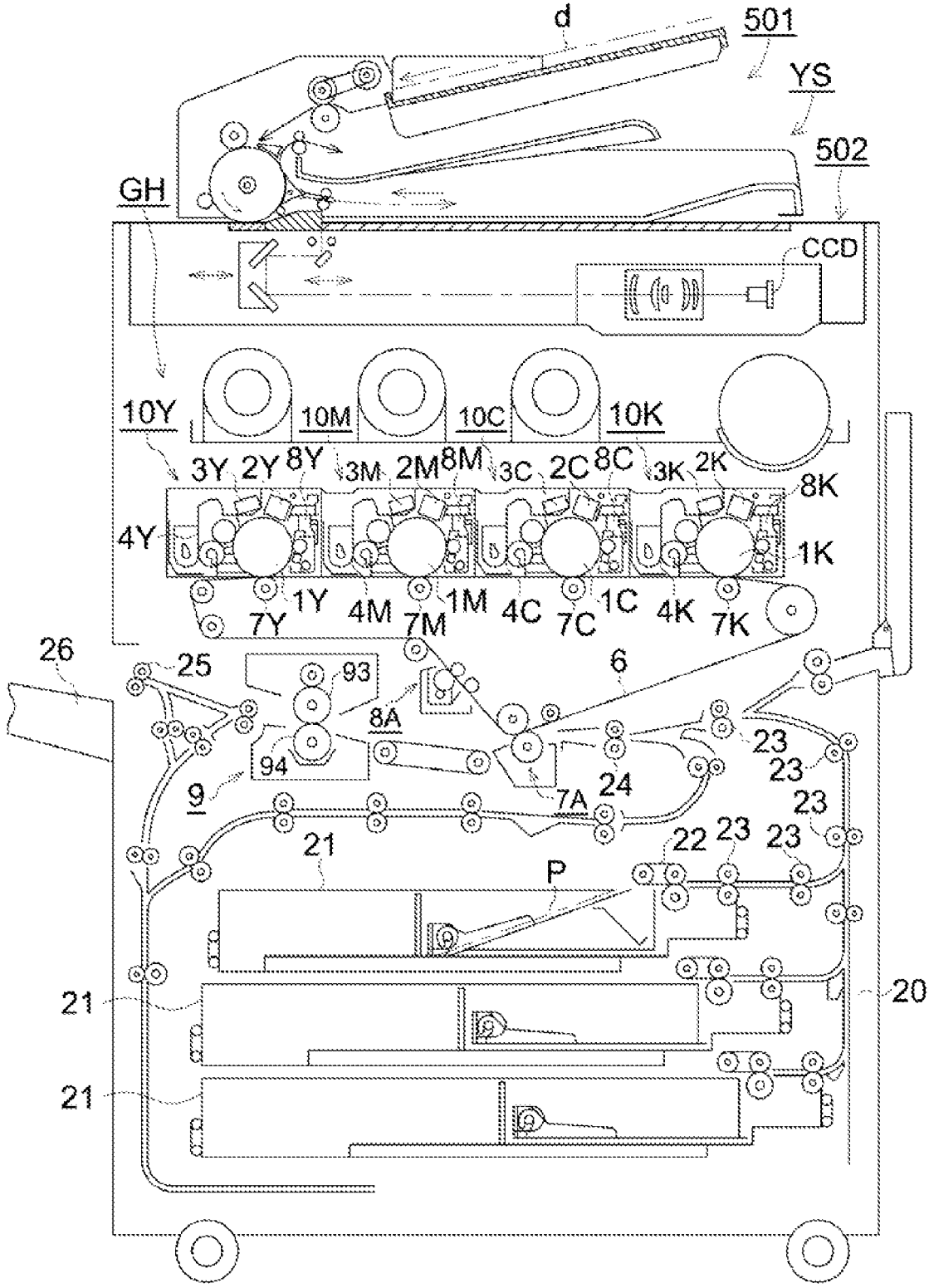
FIG. 1 shows an image forming apparatus on which the writing device of the present invention is applied.

The embodiments of the present invention will now be detailed while referring to the drawings, but the present invention will not be limited to these embodiments.

FIG. 1 is a drawing showing an example of the image forming apparatuses onto which the writing device of the present invention can be applied. The image forming apparatus relating to the present invention is not limited to the embodiments detailed below.

The present image forming apparatus is structured of printer section GH and image reading device YS.

Printer section GH is called a "tandem type color image forming apparatus", which is structured of image forming sections 10Y, 10M, 10C and 10K, intermediate transfer body 6, being a belt, transfer section 7A, sheet supplying section 20, and fixing device 9.

Image reading device YS, structured of automatic document feeding device 501 and scanning exposure device 502, is installed above printer section GH. Document sheet "d", placed on a document platen of automatic document feeding device 501, is conveyed by a conveyance section, after which images carried on a single surface or on both surfaces of document sheet d is scanned and exposed by an optical system of scanning exposure device 502, whereby the images are read by line image sensor CCD.

Signals, which have been photo-electrically converted by line image sensor CCD, are processed, employing such as an analog process, an A/D conversion process, a shading process, and an image compressing process, after which said signals are sent to LPHs 3Y, 3M, 3C and 3K, which serve as the writing device.

Image forming section 10Y, which forms yellow toner images, has charging section 2Y, writing device 3Y structured of the LPHs, developing device 4Y, and cleaning section 8Y, all of which are arranged around photoconductor 1Y.

Image forming section 10M, which forms magenta toner images, has charging section 2M, writing device 3M structured of the LPHs, developing device 4M, and cleaning section 8M, all of which are arranged around photoconductor 1M.

Image forming section 10C, which forms cyan toner images, has charging section 2C, writing device 3C structured of the LPHs, developing device 4C, and cleaning section 8C, ail of which are arranged around photoconductor 1C.

Image forming section 10K, which forms black toner images, has charging section 2K, writing device 3K structured of the LPHs, developing device 4K, and cleaning section 8K, all of which are arranged around photoconductor 1K.

In addition, developing devices 4Y, 4M, 4C and 4K include a dual component developer including toners of yellow (Y), magenta (M), cyan (C) and black (K), and carriers.

Intermediate transfer body 6 is entrained about a plurality of rollers so that it can rotate.

Fixing device 9 includes fixing roller 93, having a heater and pressure roller 94 to press against fixing roller 93. Fixing roller 93 and pressure roller 94 nip sheet P carrying the toner images so that the toner images are fixed by the heat and pressure.

Each color toner image, formed by image forming sections 10Y, 10M, 10C and 10K, is primarily and sequentially transferred onto rotating intermediate transfer body 6 by transfer section 7Y, 7M, 7C and 7K, so that each color image is superposed, and a full color image is formed on intermediate transfer body 6.

Recording sheets P, stored in sheet supplying cassette 21, are sequentially conveyed by sheet supplying rollers 22 of sheet supplying section 20, and are conveyed via paired sheet supplying rollers 23 to paired registration rollers 24, which are in a stopped status. Sheet P temporarily stops there, after the leading edge of sheet P and the toner image on transfer body 6 are made to synchronously meet each other, paired registration rollers 24 start to rotate so that sheet P is conveyed to transfer section 7A, where a color image is transferred onto recording sheet P, which is the secondary transfer operation. Sheet P, onto which the color image has been transferred, is heated and pressed at fixing device 9, so that the full color image is fixed onto sheet P. Then, sheet P is ejected by paired ejection rollers 25 onto sheet ejection tray 26, attached to the outside of the apparatus.

Concerning intermediate transfer body 6 which has already transferred the full color toner image onto sheet P via transfer section 7A, any remaining toner on intermediate transfer body 6 is cleaned via cleaning section 8A.

The above explanation is for the color image forming apparatus, however the present invention is also applicable to a monochromatic image forming apparatus.

For fixing device 9, a heated roller fixing device is used in the present embodiment, however, a belt fixing device can also be used.

Next, precise positional adjustment of the LPH of the writing device will be detailed while referring to FIGS. 2-5.

Since writing devices 3Y, 3M, 3C and 3K have an identical structure, and photoconductors 1Y, 1M, 1C and 1K also have an identical structure, an example is shown in which a simple numeral 3 represents any writing device, and numeral 1 represents any photoconductor.

Figure 2:
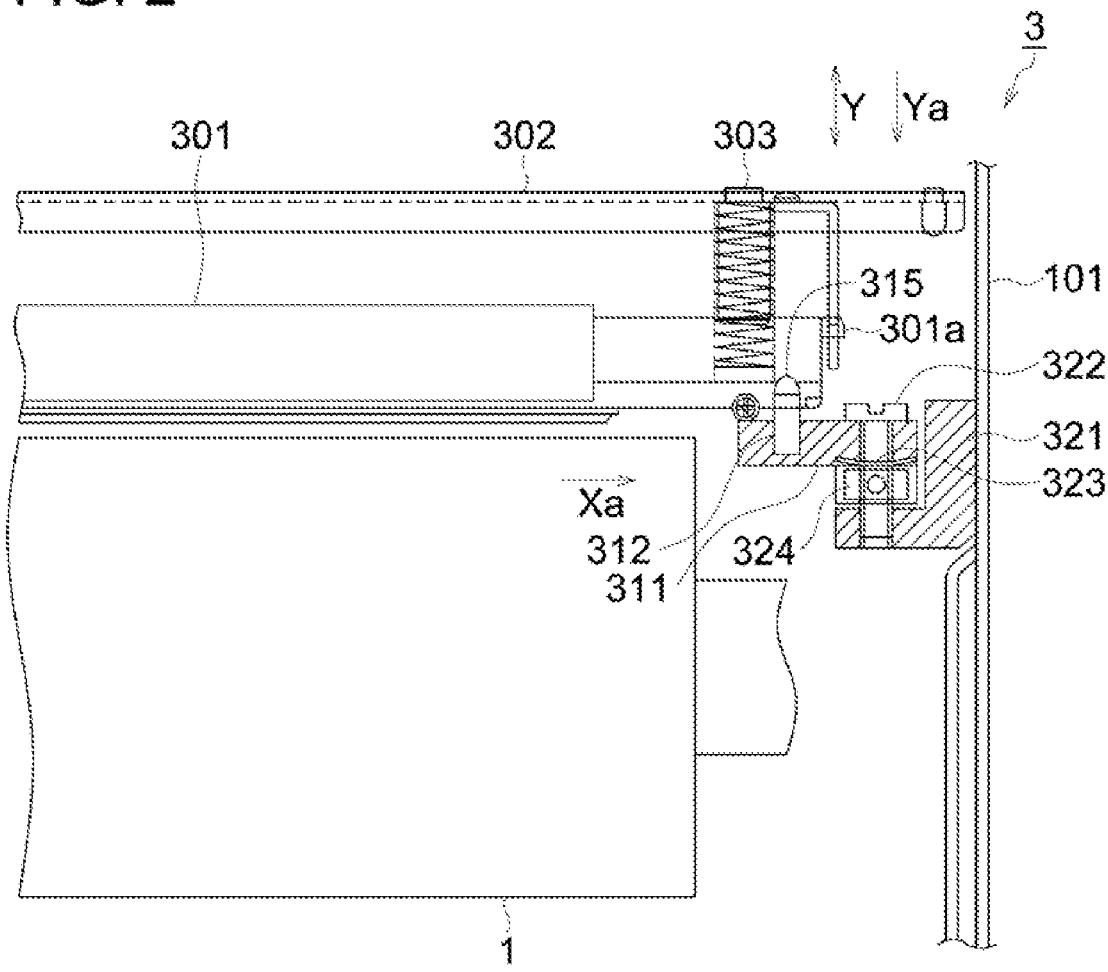
FIG. 2 is a front view to show assembling of the LPH and a mechanical structure of the positional adjustment of the LPH.
Figure 3:
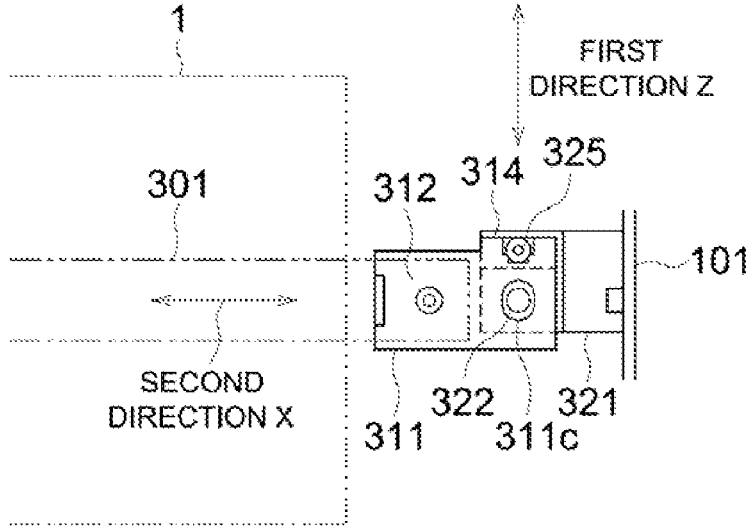
FIG. 3(*a*) is a plane view viewed in a direction of arrow Ya in FIG. 2.
Figure 3:
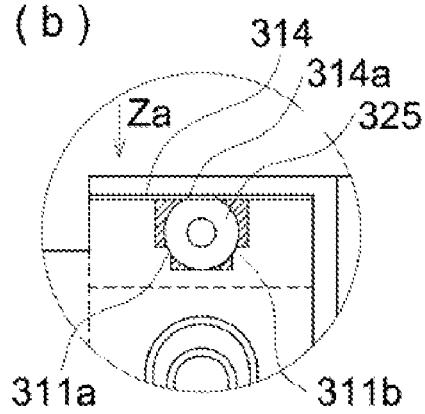

FIG. 2 is a front view of LPH 301 of writing device 3, in which a mechanical structure of the positional adjustment of LPH 301 is illustrated. Only one side of writing device 3 (which is the deepest section in the depth direction of FIG. 1) is shown in FIG. 2, but an opposite section (which is the rear side in FIG. 1) also has the same structure. FIG. 3(*a*) is a plane view viewed in the direction of arrow Ya in FIG. 2, in which the head section of adjustment screw 322 is not illustrated. FIG. 3(*b*) is an enlarged view of a portion of FIG. 3(*a*). FIG.

Figure 4:
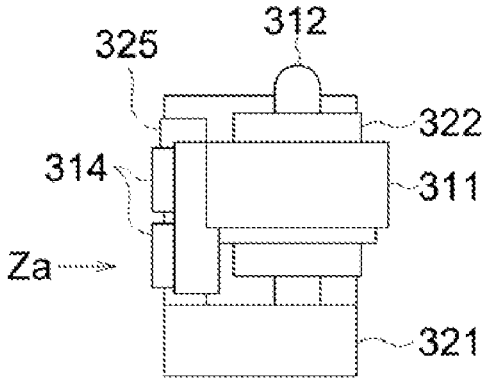
FIG. 4 is a side view viewed in a direction of arrow Xa in FIG. 2.
Figure 5:
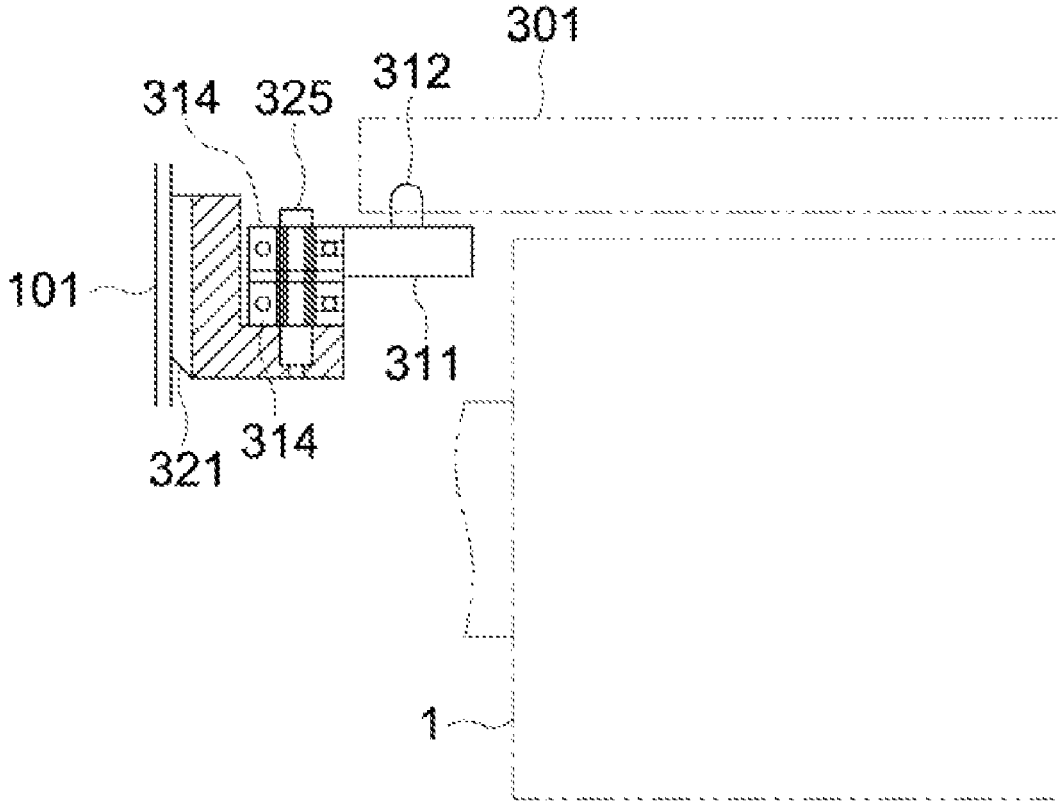
FIG. 5 is a rear view viewed in a direction of arrow Za in FIG. 4.

4 is a side view viewed in the direction of arrow Xa in FIG. 2, and FIG. 5 is a rear view viewed in the direction of arrow Za in FIG. 4.

Figure 6:
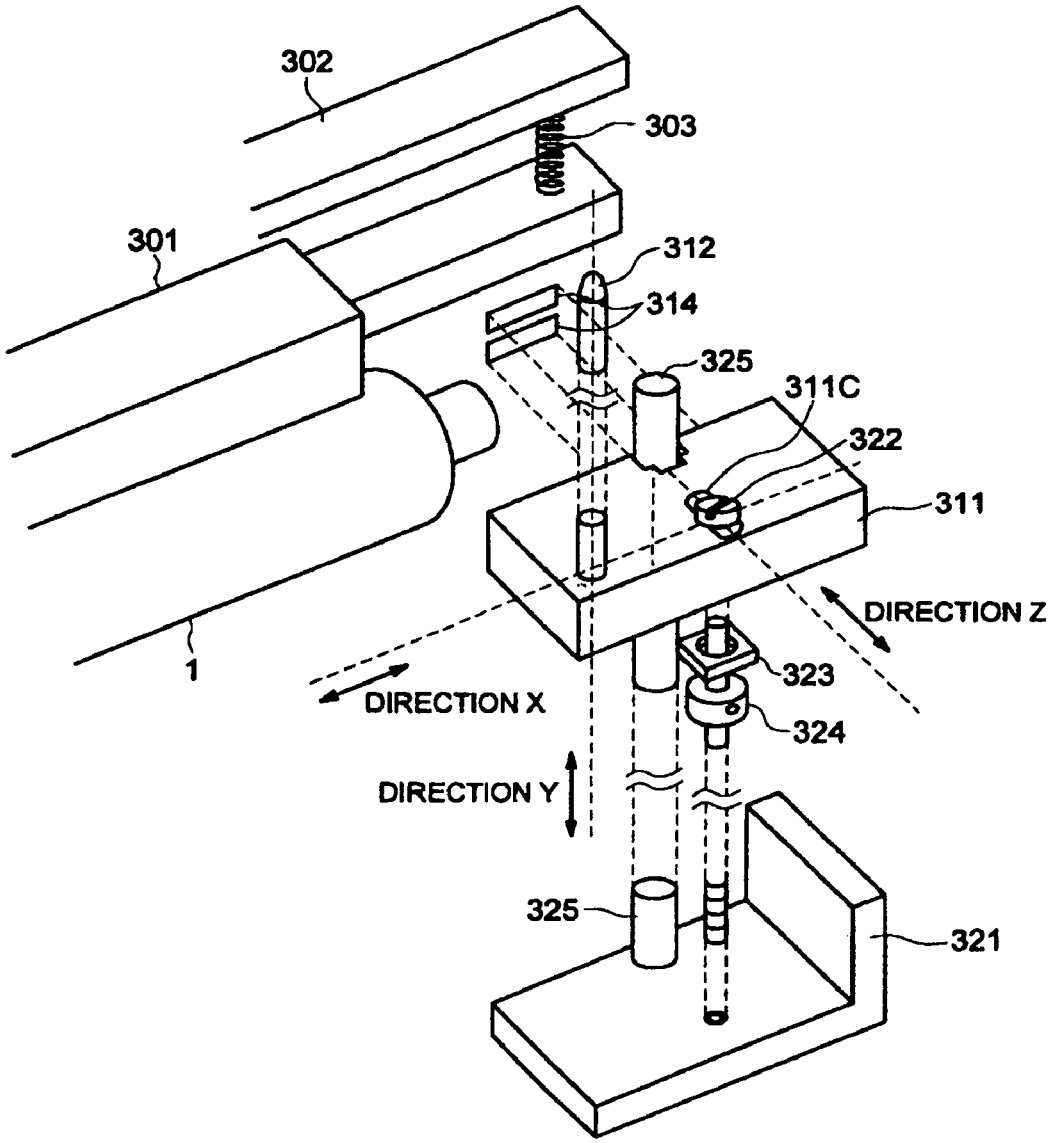
FIG. 6 is an exploded isometric view to show a LPH and a mechanical structure of the positional adjustment of the LPH.

FIG. 6 is an exploded isometric view to show a LPH 301 and a mechanical structure of the positional adjustment of the LPH 301.

In FIG. 2, photoconductor 1 is supported by a supporting section (which is not illustrated) mounted on frame 101, and said photoconductor 1 is rotated by a driving section (which is also not illustrated).

LPH 301 is supported by second supporting member 321 mounted on frame 101 via first supporting member 311.

First supporting member 311 is supported by reference shaft 325 (which is not shown in FIG. 2) provided on second supporting member 321. That is, in FIG. 3(*a*), pressuring spring 314, being a plate spring, which is a pressuring member and provided within first supporting member 311, pushes reference shaft 325 in the direction shown by arrow Za, whereby contacting sections 311*a* and 311*b* of first supporting member 311, and contacting section 314*a* of pressuring spring 314 come into contact with reference shaft 325. Due to these contacting sections, supporting member 311 is supported by reference shaft 325.

Clearances [which are shaded portions in FIG. 3(*b*)] between reference shaft 325 and first supporting member 311, which are other than between reference shaft 325 and two sections, being contacting sections 311*a* and 311*b*, and between reference shaft 325 and an one section, being pressuring spring 314, are preferably 2 mm or less. Because, when reference shaft 325 is locked after the position of LPH 301 has been adjusted, locking agents are inserted in the clearance gaps to lock the adjusted position of reference shaft 325, whereby the amount of the locking agents can be reduced and prevented from leaking from said clearance gaps, further, filling work of the locking agents into the clearances becomes easier. Additionally, since there are three contacting sections with reference shaft 325, the surface area to contact with the locking agent can be increased.

Adjustment screw 322, which allows first supporting member 311 to move to or separate from photoconductor 1 in direction Y, rotatably engages first supporting member 311.

Reference shaft 325 and adjustment screw 322 are arranged in first direction Z as shown in FIG. 3(*a*).

In FIG. 2, in the axial-directional position of adjustment screw 322, first supporting member 311 is controlled by the head section of adjustment screw 322 and restriction shaft 324 fixed onto adjustment screw 322. Pressure applying spring 323, being an elastic member, is mounted between restriction shaft 324 and first supporting member 311, to apply pressure against adjustment screw 322. Due to this structure, all play is prevented from occurring in the axial direction of adjustment screw 322 of first supporting member 311, and adjustment screw 322 can be rotated smoothly. Pressure applying spring 323 is listed as a blade spring, a spring washer and the like.

Since the screw section of adjustment rivet 322 mates with a threaded hole of second supporting member 321, first supporting member 311 and second supporting member 321 are engaged with each other, with adequate clearance. When adjustment screw 322 is rotated, first supporting member 311, which is supported by reference shaft 325, is driven against or separated from photoconductor 1, so that the position of first supporting member 311 is precisely controlled. In addition, when the position is controlled again in the market, the above described locking agents can be broken, if adjustment screw 322 needs to be rotated.

In FIG. 3(*a*), through-hole 311C, which engages adjustment screw 322 of first supporting member 311, preferably has a larger diameter in first direction Z. Because first supporting member 311 is pressed against reference shaft 325, so that the position of first supporting member 311 is restricted, therefore said through-hole 311C is formed to be a long hole, providing clearance in first direction Z.

The pitch of adjustment screw 322 is preferably 0.5 mm or less. The moving length of supporting member 311 moved by a single rotation of adjustment screw 322 is set at most to 0.5 mm in direction Y in FIG. 2, which is preferable for precise adjustment.

As described above, in order to support first supporting member 311, pressuring spring 314 presses against reference shaft 325, adjustment screw 322 is controlled to allow no play nor to angle due to the back lash, while movement.

LPH 301 has engaging hole 315 which engages a ball section at the top of LPH's position determining shaft 312, which is provided on first supporting member 311, to serve as a position determining section. The position of LPH 301 is determined by the engagement of engaging hole 315 and the top of LPH's position determining shaft 312, where LPH 301 is supported by first supporting member 311. LPH's position determining shaft 312 and adjustment screw 322 are arranged in second direction X which is perpendicular to first direction Z in FIG. 3(*a*).

Further in FIG. 2, LPH 301 has rotation preventing pin 301*a*, which projects upward, so that when said rotation preventing pin 301*a* engages on-LPH supporting plate 302, any rotation of LPH 301 is prevented. One end of holding spring 303, serving as an elastic member, is supported by on-LPH supporting plate 302. LPH 301 is pressed against first supporting member 311 by the other end of holding spring 303, so that LPH 301 and first supporting member are integrally supported.

When adjustment screw 322 is rotated, first supporting member 311 is driven against or separated from photoconductor 1 so that the positional adjustment of LPH 301 is precisely adjusted.

when the above adjustment operation of LPH 301 is conducted by the rotation of adjustment screw 322 mounted through first supporting member 311, LPH 311 is slightly declined (which is 0.1 mm or less) in first direction Z, due to the frictional resistance of the contacting points between reference shaft 325 and first supporting member 311. Since LPH 301 is structured of the LED arrays in which a plurality of very minute LEDs are arranged, even though said decline is very slight in the longer direction of LPH 301, out-of-focus can occur, which results in unacceptable image quality.

To overcome this problem, in the present invention, as described above, first direction Z, which is from reference shaft 325 to adjustment screw 322, makes a right angle with second direction X, which is from LPH's position determining shaft 312 to adjustment screw 322. Accordingly, the present invention includes a structure in which any decline of first supporting member 311 in first direction Z has no adverse influence upon direction X. Any out-of-focus phenomenon, which is due to decline of first supporting member 311 in direction Z, is prevented by this structure, and thereby, the high quality of formed images is maintained. Further, though the focal position is very slightly shifted on the circumference of photoconductor 1, it has no adverse influence on the demanded high image quality.

That is, the writing device can be created in which the position of PLH is adjusted with an accuracy which is superior to the manufacturing accuracy of the mechanical parts, and which incorporates the LPH's positional adjustment mechanism which does not cause any adverse change of the LPH's position with age. Further, since an adjusting method using an adjustment screw is employed, precise adjustment is easily attained, and when the demanded high image quality, such as in the case of print-on-demand, optimum adjustment, matched to an individual LED and photoconductor, can be conducted in the field.

Based on the structure of the present invention, the first supporting member is supported by the reference shaft and the first supporting member is moved to or separated from the photoconductor, further, the first supporting member is pressed against the reference shaft by the pressuring member, whereby any play due to backlash in the adjustment screw is prevented, and precise adjustment is easily conducted. Further, since the first direction which is from the position determining section to the adjustment screw makes a right angle with the second direction, which is from the adjustment screw to the reference shaft, the inclination of the second direction, caused by the movement of the first supporting member during adjustment, is prevented from any affects on the first direction. Due to these effects, the inclination of the second direction does not adversely affect on focusing of the LPH, and out-of focus images are prevented.

What is claimed is:

1. A writing device to write an image onto a photoconductor, comprising:

a print head including a plurality of LEDs, arranged above and across a width of a photoconductor, which forms an electrostatic latent image on the photoconductor, and the print head including an engaging hole;

a first supporting member, including a position determining section which engages the engaging hole to determine a position of the print head against the photoconductor, and an adjustment screw which adjusts a position of the position determining section mounted on the first supporting member, the adjusting screw being capable of being locked after the position of the print head is determined; and a second supporting member which is engaged with the first supporting member by the adjustment screw, including a reference shaft mounted in parallel to the adjustment screw on the second supporting member and positioned for coming into contact with the first supporting member to movably support the first supporting member in a direction in which the print head moves to or separates from the photoconductor, and a pressuring member which presses the reference shaft against the first supporting member, wherein a first direction, defined parallel to a face of the first supporting member and extending along a first line through the position determining section and the adjustment screw, forms a right angle with a second direction, defined parallel to the face of the first supporting member and extending along a second line through the adjustment screw and the reference shaft that is offset from the adjustment screw.

2. The writing device of claim 1, wherein a pitch of the adjustment screw is 0.5 mm or less.

3. The writing device of claim 1, wherein the pressuring member comprises a plate spring.

4. The writing device of claim 1, wherein the first supporting member includes a through-hole which engages the adjustment screw, and the through-hole has a larger diameter in the first direction.

5. The writing device of claim 1, wherein the reference shaft comes into contact with the first supporting member at two sections, and also comes into contact with the pressuring member at a single section.

6. The writing device of claim 1, wherein the clearances other than between the reference shaft and the first supporting member, and the clearances other than between the reference shaft and the pressuring member, are 2 mm or less.

* * * * *